US005664354A

United States Patent [19]

Daviau et al.

[11] Patent Number: 5,664,354

[45] Date of Patent: Sep. 9, 1997

[54] WALL AND VEHICLE GRAPHIC ASSEMBLIES

[75] Inventors: John R. Daviau; Mark M. Pekkerman, both of Thornhill, Canada

[73] Assignee: Mobile Billboard Advertising Inc., Mississauga, Canada

[21] Appl. No.: 568,280

[22] Filed: Dec. 6, 1995

[51] Int. Cl.[6] ..... G09F 17/00

[52] U.S. Cl. ..... 40/603; 40/590; 160/328

[58] Field of Search ..... 40/590, 603, 604, 40/624; 160/327, 328, 354, 387

[56] References Cited

U.S. PATENT DOCUMENTS

| | | | |
|---|---|---|---|
| 243,962 | 7/1881 | Palmer | 160/DIG. 7 X |
| 402,439 | 4/1889 | Haas | 160/328 |
| 575,951 | 1/1897 | Holcomb | 160/327 X |
| 2,415,200 | 2/1947 | Willett et al. | 160/328 |
| 2,822,634 | 2/1958 | Salyers et al. | 40/604 X |
| 4,210,191 | 7/1980 | Li | 160/328 X |
| 4,395,079 | 7/1983 | Yano et al. | 312/7.1 |
| 4,580,361 | 4/1986 | Hillstrom et al. | 40/603 |
| 4,906,503 | 3/1990 | De La Cruz et al. | 40/603 X |
| 5,058,299 | 10/1991 | Suzuki | 40/603 |
| 5,239,765 | 8/1993 | Opdahl | 40/603 |
| 5,349,772 | 9/1994 | Pardue | 40/603 X |
| 5,373,653 | 12/1994 | Suzuki | 40/603 |
| 5,507,109 | 4/1996 | Rinzler | 40/603 |
| 5,522,165 | 6/1996 | Molla | 40/604 |
| 5,543,196 | 8/1996 | Robinson et al. | 160/387 X |
| 5,555,659 | 9/1996 | Hade | 40/604 |

FOREIGN PATENT DOCUMENTS 0078391 5/1983 European Pat. Off. .

*Primary Examiner*—Brian K. Green
*Assistant Examiner*—Andrea Chop
*Attorney, Agent, or Firm*—Cushman Darby & Cushman Intellectual Property Group of Pillsbury Madison & Sutro LLP

[57] ABSTRACT

A system of temporarily covering the wall of a building; a signage surface, billboard, glass store from and the like, particularly, a side of a vehicle, with text, artwork, logos and the like, particularly advertisement matter. The assembly comprises in combination, a substrate having a substantially planar surface; a cover to cover the substrate surface in whole or in part; retaining the cover adjacent the substrate surface; and tension adjusting the cover.

7 Claims, 5 Drawing Sheets

WALL AND VEHICLE GRAPHIC ASSEMBLIES

FIELD OF THE INVENTION

This invention relates to a system of temporarily covering the wall of a building, a signage surface, billboard, glass store front and the like, particularly, a side of a vehicle, with text, artwork, logos and the like, particularly advertisement matter.

BACKGROUND TO THE INVENTION

Fleet graphics is the term given to the presence of text, drawings, logos, and the like, particularly advertising matter, appearing on the sides of vehicles, such as trailers and vans.

Initially, all fleet side graphics were painted upon the vehicle. This method heavily restricted what types of graphics could be achieved, for example, almost all of these graphics were simple line art work, such as logos and type. Photographic type images, while not impossible to be provided were so labour intensive that they were only produced in very rare circumstances. Painted graphics were very time consuming to apply and remove and resulted in a great amount of downtime of the vehicles. Further, painted graphics had a short lifespan when compared to todays more modem vinyl based materials.

During the 1980's, new self-adhesive vinyl products were introduced to the fleet vehicle market. These materials, along with specific production methods such as screen printing and cad cam computerised cutting allowed for the mass production of vibrantly coloured and pattern specific line art graphics. These methods, when combined with the extended lifespan of these new products, allowed many sign making businesses to get involved in the business of fleet graphics as a secondary product line. It also provided customers with graphics which were color 2 and design consistent, Today, approximately 85 to 90 percent of all vehicle graphics are produced on vinyl materials.

Recently, improved methods within the screen printing field, combined with other new technologies, such as ink-jetting and digital imaging provides the ability to produce large format photographic type images. These images can be produced in relatively large sizes to cover the entire side of a trailer such as one having side surface dimensions of approximately 16 m×3 m. This technology has particularly interested sufficient companies who own their own fleets of vehicles and who advertise on their trailer sides and have recognized the significance of viewer impressions generated by such vehicles.

For example M.I.S.C., a major supplier of circulation statistics to the outdoor advertising industry, has stated that the average truck in an urban centre such as Toronto or Montreal generates about 12,000,000 viewer impressions per year. This use of such fleet graphics is comparable to the relatively more expensive billboards found in these same markets. When compared, as a media venue, to traditional outdoor billboard advertising, these vehicles become additionally valuable in terms of their potential to replace billboards. Many private fleet owners have realised the untapped value of these fleet graphic rolling billboards and have taken advantage of these new technologies. The fleet owners have decorated their vehicle fleets, for example, with four colour photographic images to help sell their products and/or services.

Notwithstanding that fleet graphics on commercial vehicles provide value as an advertising medium, there are several factors which make truck and trailer side advertising unacceptable to many advertisers. Notwithstanding that the media space is available to the fleet owners free of charge, since they own the trucks, many companies with private fleets have chosen not to place, for example, such large four colour photographic type advertisements on the vehicles. In most cases this is because of unfavourable factors relating to the production and the installation of the graphics themselves. The lack of economics of scale and the permanence of the installation techniques, at present, constitute a significant hindrance.

In order to be cost-effective, self-adhesive large format four colour graphics must be produced in relatively large quantities and, for example, need to remain on the vehicles for a significant minimum period of time. For graphics produced using standard production techniques, the general rule of thumb is that an advertiser to be cost-effective must decorate at least twenty trailers. It is also an accepted axiom that due to significant labour and downtime costs associated with installation and removal of these graphics, the images must remain on the vehicles for a minimum of five to seven years. These factors thus dictate that an advertiser has to be willing to produce a large number of identical advertisements and be satisfied to retain them on trailers for such an extended period of time. Therefore, only institutional types of advertisers, who own their own fleets are able to readily take advantage of this opportunity.

Those advertisers who do not own their own fleet vehicles are, understandably, justified in being leery of tying themselves to a specific fleet carrier for a relatively protracted period of time. However, such advertisers recognize the value of modem fleet graphics as applied to vehicles.

Fleet graphics currently produced involve graphics present on sheets of self-adhesive vinyl materials adhered directly to the truck or trailer body. Thus, the graphics are, in effect, permanently affixed to the vehicle and cannot be readily removed intact, stored and, optionally, re-used, if desired.

In an attempt to overcome the aforesaid disadvantages of small scale economics and unacceptably long periods of time that the same graphic work must remain on the vehicle, consideration has been given to use time systems. Such frame systems would provide for the fleet graphics vinyl coated member to be fixed to the side of the vehicle and allow for subsequent vinyl material removal.

However, there are several problems associated with use of such frame systems which have to be overcome to be acceptable to the industry. The most notable of these problems relate to the physical aspects of a frame, its relation to the vehicle and the governmental rules and regulations associated with the transport industry relating to equipment. A workable frame system has to be of a light weight, low profile and be effectively secured to the vehicle. It also has to effectively capture the graphic within the frame dimensions in order to provide the required degree of safety. A further major problem relates to the large sizes of framing systems required to completely cover a large, e.g., 7 m long truck body or a trailer which can be as long as 16 m. Smaller frame systems, 1 m×2 m, have been used for many years on vehicles, such as delivery vans, buses and streetcars, but these only allow for the mounting of small card type slip-in posters.

Such frame systems that have been developed, to-date, have used several layers of steel as their perimeter frame. Such frames are thus heavy and bulky and have only been used in sizes of about 1 m×2 m on smaller vehicles.

Thus, to-date, those companies that have tried to develop a framing system large enough to service larger vehicles have been hampered by the following factors, viz:

(i) high cost;

(ii) large size (profile) and weight;

(iii) the need for the installation of a large and heavy perimeter frame system; and (iv) the requirement of installing the graphic within a perimeter system, which is time consuming and physically cumbersome.

There, thus, remains a need for a vehicle graphics system which satisfactorily and economically overcomes the following disadvantages of the prior art, viz:

(a) the economic requirement that large numbers of vehicles must be involved;

(b) the generally unacceptable period of time for which the advertisement must remain on the vehicle;

(c) the inability to easily move the advertisement to other markets;

(d) the long downtimes required to install and remove adhesive type graphics;

(e) the tremendous expense associated with installation and removal; the installation of the graphics must be done indoors at temperatures above 60 degrees F; and (g) the inability of advertisers to effect seasonal or promotional advertising.

SUMMARY OF THE INVENTION

It is an object of the present invention to provide a fleet graphics system which overcomes the aforesaid disadvantages and which allows for the easy installation, removal transfer and re-usability of the graphic to other vehicles or sites at the option of the advertiser and, thus, addresses the present concerns of both fleet owners and marketing agencies and personnel.

Accordingly, in its broadest aspect the invention provides a graphic assembly comprising in combination, a substrate having a substantially planar surface; covering means to cover said substrate surface in whole or in part; retaining means for retaining said covering means adjacent said substrate surface; and tension adjusting means for adjusting the tension of said covering means.

The term "substantially planar surface" as used in this specification and claims includes those surfaces of a substrate that are not totally flat. For example, the sides of some trailers and trucks may be corrugated, rippled or channelled, while still generally considered to be flat. Provided that the covering member bearing the graphic design is essentially planar and essentially abutting, directly or through an intervening member, a substantial portion of the adjacent substrate, the essence of the present invention applies.

The tensioning means of use in the practice of the invention not only tensions the rope per se but also causes the edges of the cover member to be so pulled away one from the other as to cause stretching to effect tautness of the cover member.

The system according to the invention provides both advertisers and fleet owners with workable solutions to their respective problems.

Advertisers have the assembly of the invention available to them that:

(i) will allow the .graphics to be either screen printed or ink-jotted;

(ii) will allow use of substrates that are non-adhesive and, therefore, removable;

(iii) Will allow the graphic images to be stored and reused;

(iv) will allow the actual graphics to be shipped to other markets for reuse;

(v) will provide graphics which can be used in a given market for either short or long term programs;

(vi) will allow the graphics to be installed and removed in minutes and can thus greatly reduce costs.

On the other hand, the invention provides the fleet owners with a system that:

(i) will allow installations to be done at any time in any location;

(ii) wherein the graphics will not damage truck or trailer surfaces;

(iii) wherein the advertisers graphics can be placed optionally over any existing adhesive style graphics;

(iv) wherein there will be virtually no down-time associated with installing graphics using this system of the invention, and (v) which provides an extremely light weight system which has a very low profile, and may, optionally, protrude no further off the vehicle body side than the vehicle indicator signals.

Thus, both advertisers and fleet owners will benefit from the relatively low cost of the system. The former from reduced costs of outdoor advertising and the latter from the new revenues generated by turning the sides of their vehicles into media space.

It will be readily understood that the system of the present invention is applicable to all fields of industry and trade that uses graphics, such as text, drawings, designs, marks, logos and the like, as advertisement matter, informative matter, instructional matter and the like on a substrate, such as the top, rear and sides of a vehicle, such as a trailer, van, bus, train, boat; the wall or roof of a building; signage on or above shop or store fronts or windows, doors and billboards.

The present invention provides for the use of screen printing and ink-jetting of the graphic design on the coveting member. This, thus, permits for relatively short runs, i.e. less than ten trailer or truck programs as well as for longer production run programs.

The system of the invention preferably uses a non-adhesive covering member upon which the graphic design is printed. Examples of such covering materials are canvas, tarpaulin materials and plastic materials. Preferably, materials of use in the "flexface" signage field are used. Such materials are provided to be either screened or ink-jetted, while having the desired tensile strength required to withstand the environmental conditions of wind, rain, snow, ice, extremes of hot and cold temperatures, while having colour fast durability. Examples of preferred materials are PANAPLEX™ plastics material and FORBO-like sheeting materials.

A preferred assembly according to the invention uses an endless loop of wire rope such as a lightweight aircraft cable which is threaded around the perimeter of the graphic bearing covering member through hemmed or otherwise formed longitudinal pockets at the periphery of the covering member. The graphic itself is printed on the lightweight flexface sign material forming the covering member similar to the materials used in rear lit billboards. This material has tremendous strength, ripstop scrimming and yet allows for the right amount of stretching required to tighten the graphic. The loop of cable is passed around pivotally mounted cams suitably located adjacent the corners of the covering member. The covering member is suitably shaped at its corners as to not interfere with the movement of the cams.

Each of the cams are pivotally mounted to the substrate and may be rigidly held in their "extended" positions by bolts. In this locked extended position the cams have tighted the wire rope and caused the covering member to become taut adjacent the substrate surface and provides the desired appearance to the graphics.

When desired, the cam bolts are removed and loosened to allow of pivotal movement of each cam to its "relaxed" position which causes the wire rope and covering member to relax and enables the rope to be readily and easily removed off the cams and from the assembly.

It will be understood that the covering member can be of any desired dimension and shape as deemed suitable for covering the substrate in whole or in part. The substrate, particularly a trailer side may have more than one graphic bearing cover member. For example, the side of the trailer may, optionally, carry two, three or more such graphic assemblies. Suitable retaining and stretching means can be readily selected and suitably located.

To reduce the risk of wind getting between the substrate and the cover member, a peripheral molding is preferably installed over the periphery of the assembly.

The assembly of the present invention embraces those assemblies that include one or more intervening members placed between the substrate and the covering member, e.g. to provide additional support or to smooth out irregularities in the surface of the substrate or covering member.

BRIEF DESCRIPTION OF THE DRAWINGS

In order that the invention may be better understood, preferred embodiments will now be described by way of example only, with reference to the accompanying drawings wherein.

DETAILED DESCRIPTION OF PREFERRED EMBODIMENTS

Figure 1:
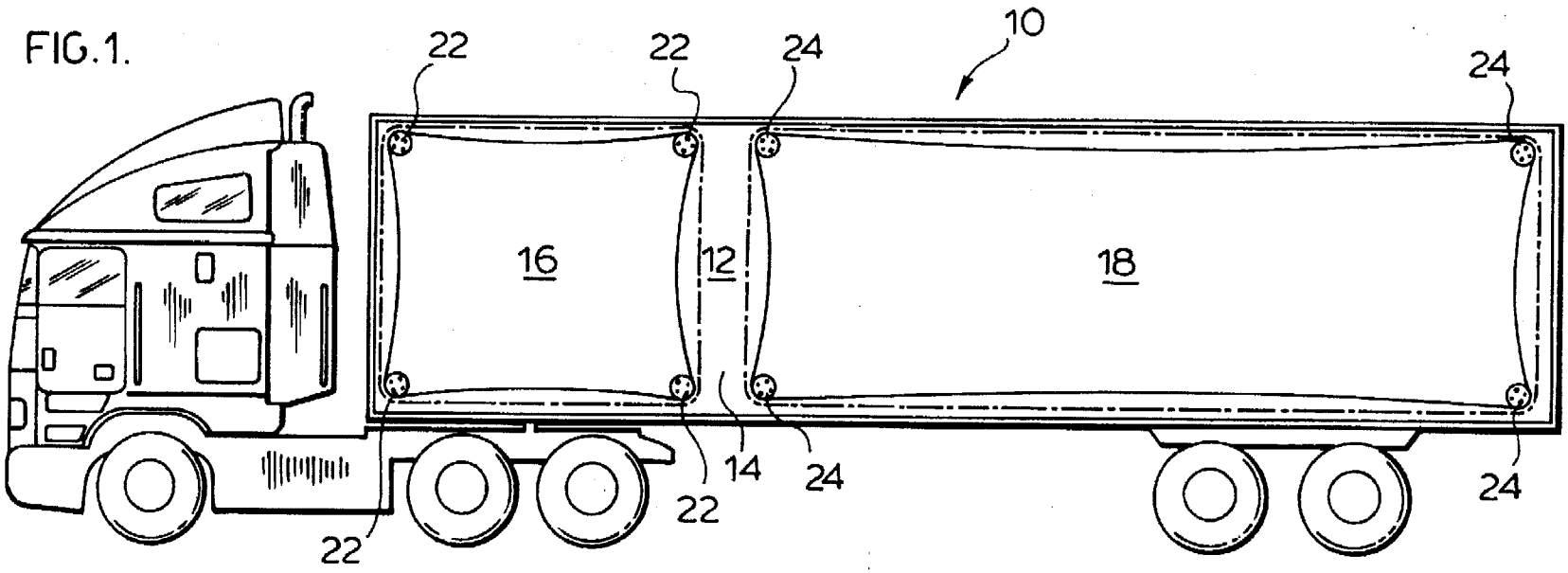
FIG. 1 represents a diagrammatic side view of a truck and several frames assemblies having cover members in both loose and taut configuration according to the invention.

FIG. 1 shows generally as 10, a truck having a side 12 formed of aluminum and having a substantially planar outer surface 14 defining a substrate.

Intimately adjacent surface 14 are two rectangularly-shaped planar cover members 16 and 18, formed of PANAPLEX™ plastics material. Each of cover members 16 and 18 is affixed to side 12 by a plurality of cams, four in the embodiment shown, 22 and 24 respectively, as follows.

Figure 5:
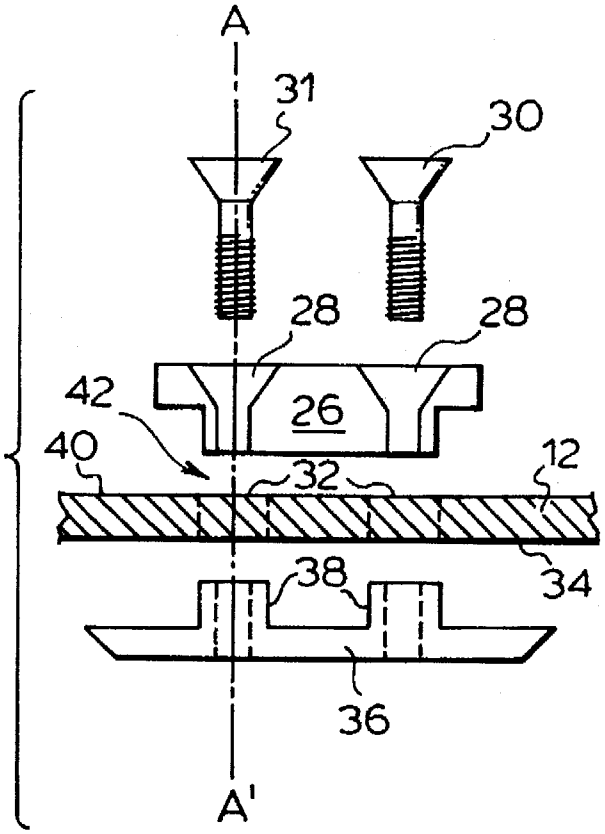
FIG. 5 represents a diagrammatic cross-section of a diassembled cam and side wall fitting of use in the present invention.

With reference also to FIG. 5 each of cams 22, 24 has a body portion 26 defining a pair of diametrically opposed countersunk bolt recesses 28 for receiving threaded bolts 30, 31. Side 12 has a pair of receiving apertures 32 so located as to receive both of bolts 30, 31 when the cam is in its extended position as hereinafter explained. Side 12 on its inner surface 34 is affixed to a supporting bracket 36 having suitably located inner threaded studs 38 received by apertures 32 and bolts 30, 31, whereby each cam may be rigidly held to side 12 and bracket 36 by bolts 30 and 31. Each of cams 22, 24 intimately abut outer side surface 40 of side 12, to define a rope receiving channel 42.

Figure 4:
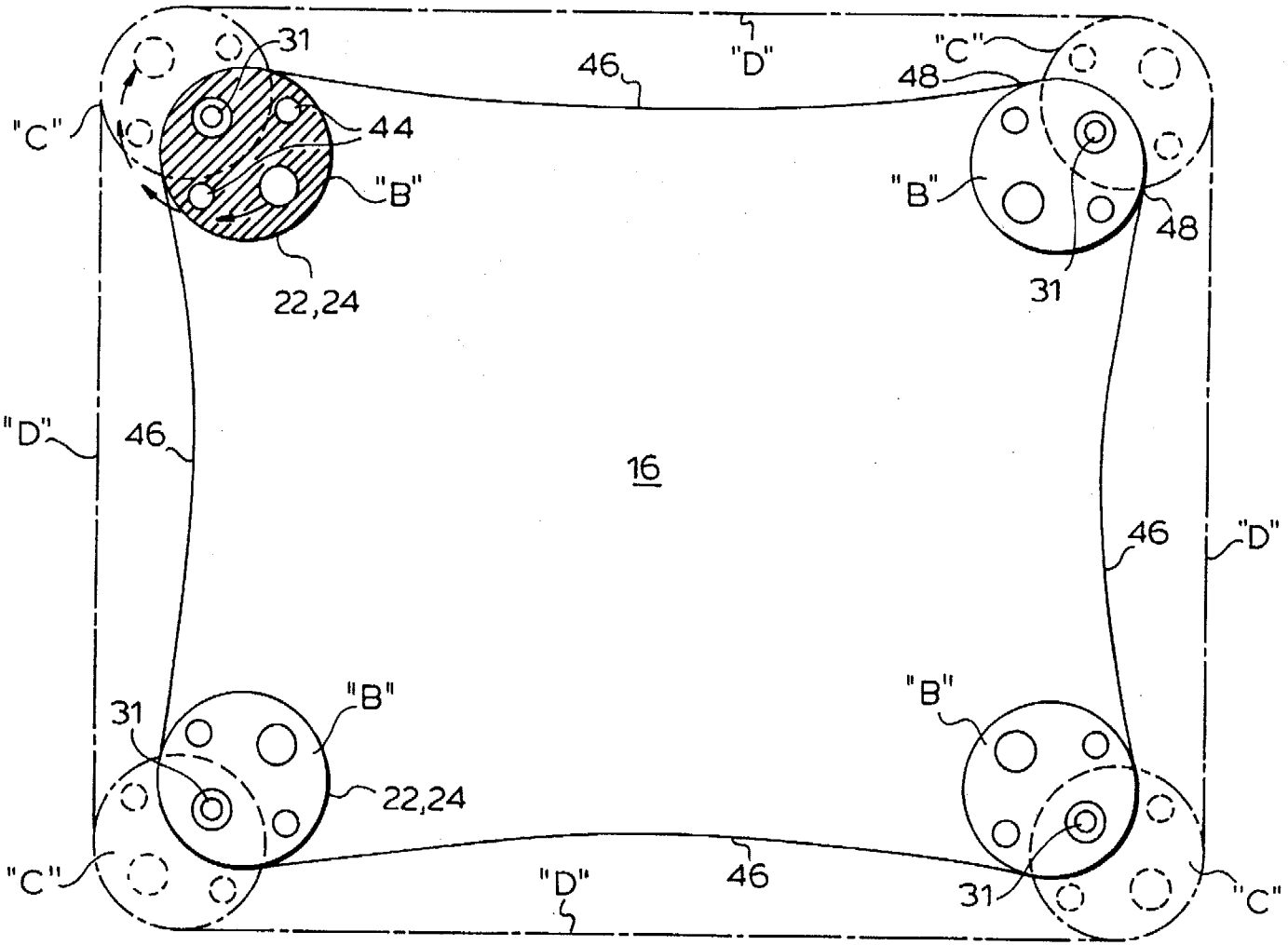
FIG. 4 represents a diagrammatic side view of an assembly showing taut and loose cover members according to the invention.
Figure 7:
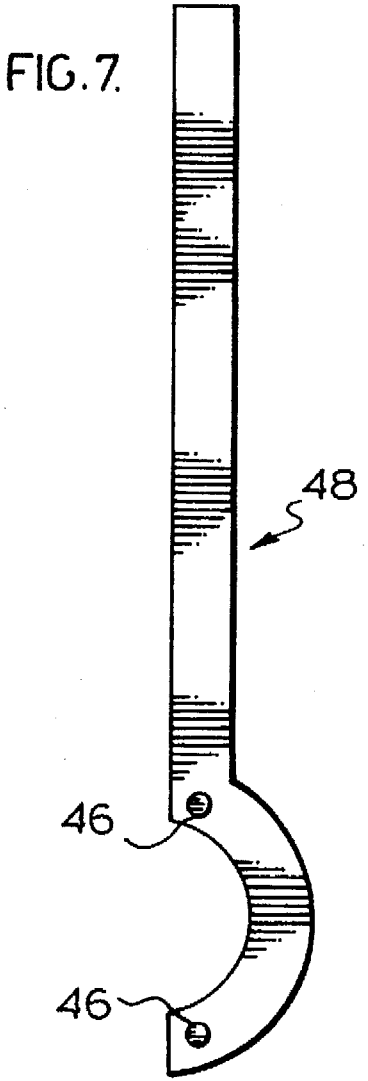
FIGS. 6 and 7 represent diagrammatic side and top views, respectively, of a two-pronged cam turning tool of use in the invention.
Figure 6:
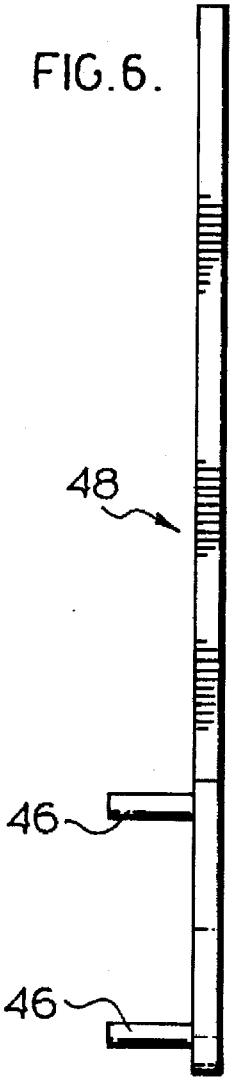

With reference also now to FIGS. 4, 6 and 7, each of cams 22 and 24 has body portions defining a pair of diametrically opposed recesses 44 for operably receiving a pair of upstanding prongs 46 of a cam rotating tool 48. Thus, in their fully extended position, each of cams 22 and 24 may be rigidly affixed to side 12 and bracket 36.

Removal of remote bolt 30 and loosening of bolt 31 enables each cam to be pivoted around axis A—A' of bolt 31, recesses 28, 32 and stud 38 to enable each cam to adopt a non-extended position as shown as solid line B in FIG. 4.

FIG. 4 shows cover member 16 in its loose arrangement, as hereinafter explained, having prefabricated channel peripheral portions 46. Portions 46 define longitudinal wire receiving passages which receive wire rope 48. Wire cable 48 in its relaxed form, is looped over and retained by each of cams 22 when cams 22 are in their non-extended position B and retained within channel 42 when cams 22 are in their extended position C (FIG. 4).

To extend cover member 16 to its stretched position, cam 22 is rotated and pivoted around bolts 31 by tool 48 to its extended position and locked therein by insertion of bolt 30 and tightening of bolts 30 and 31. This action causes wire 46 to be extended, become taut and adopt the position shown as dotted line D in FIG. 4.

The cams are preferably located adjacent the corners of the cover member, which corners are suitably shaped as to not interfere with the movement of the cams.

The assembly system in its taut form after stretching is provided along the full periphery of the cover member with a molding of suitable material, such as aluminum, to prevent entry of air between track side 12 and cover member 16 and blowing out of cover member 16.

It can thus be understood that removal or substitution of graphic-bearing cover member 16 by the simple action of aforesaid bolts removal and cam rotations enables fast and easy assembly and disassembly of the assembly.

Figure 3:
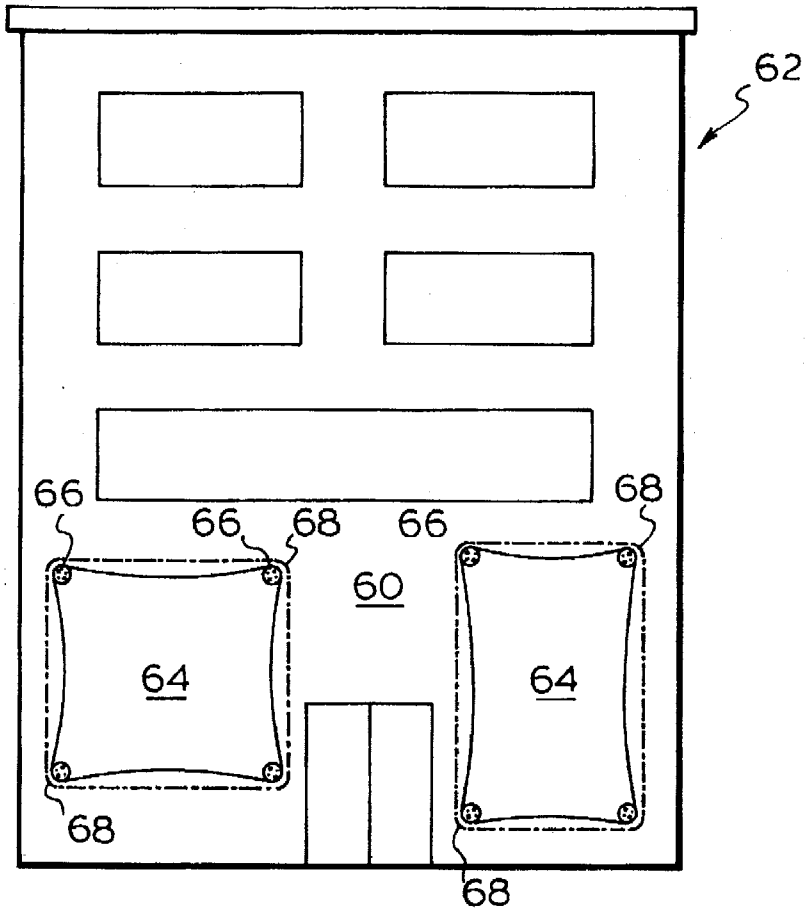
FIG. 3 represents a diagrammatic front view of a wall of a building and a frame system according to the invention.
Figure 2:
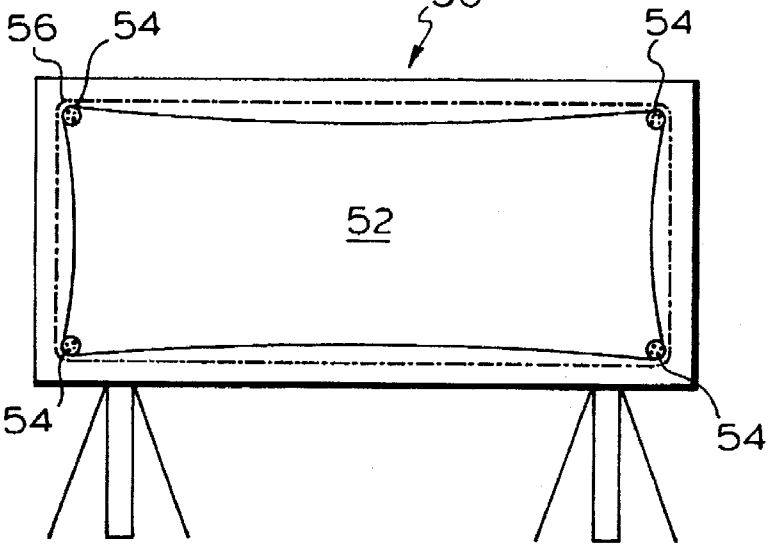
FIG. 2 represents a diagrammatic front view of an advertisement billboard and frame system according to the invention.

FIG. 2 shows an advertisement billboard 50 having a graphic bearing member 52, cam 54 and wire rope 56 assembly while FIG. 3 shows a wall 60 of a building 62 having graphic bearing cover members 64, cams 66 and wire ropes 68 assembly as hereinbefore described with reference to the trailer assembly shown in FIGS. 1, 4 and 5.

Figure 8:
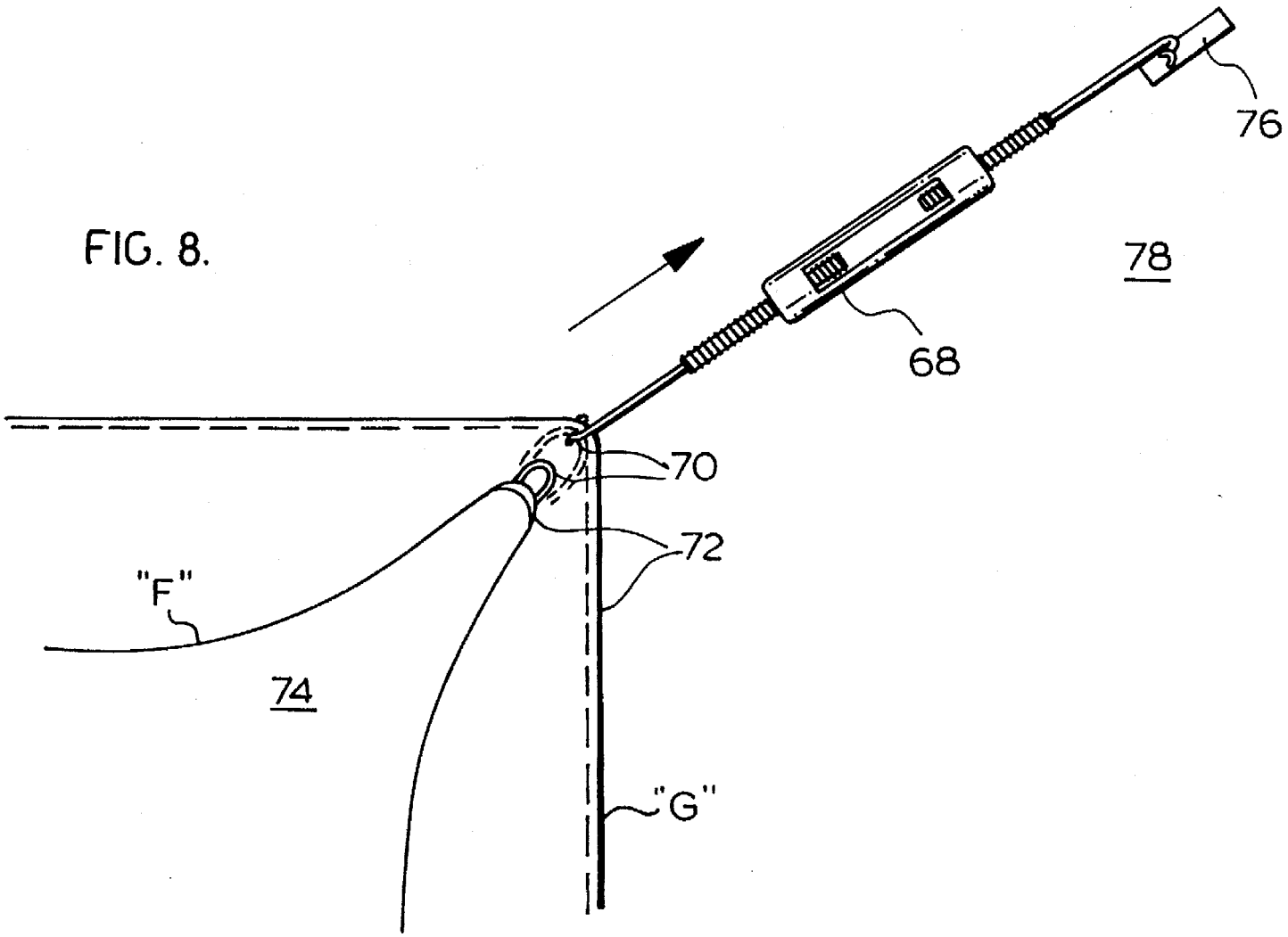
FIG. 8 represents a diagrammatic view, in part, of a turnbuckle and canvas arrangement of use in an alternative embodiment of the invention.

In an alternative embodiment shown in FIG. 8, a suitably located turnbuckle wire cable tightening and loosening arrangement is utilized having one or more turnbuckles adjacent each corner or intermittent along the top, bottom and side peripheries of the cover member 16.

FIG. 8 shows turnbuckle 68 retaining loop 70 of wire rope 72 emerging from longitudal peripheral passages of covering member 74. Tightening of turnbuckle 68 causes tensioning of rope 72 and covering member 74 through displacement of loop 70 in the diagonal direction shown by arrow from the relaxed rope and cover member position F (solid lines) to taut position G (dotted lines). Turnbuckle 68 is fastened by a fitting 76 at a side of a trailer 78.

The cover member may be fastened and tensioned by alternative suitable fastening means such as a plurality of clasp members suitably located around and to the periphery of the covering member.

While the invention has been described in detail and with reference to specific embodiments thereof, it will be apparent to one skilled in the art that various changes and modifications can be made therein without departing from the spirit and scope of invention as described and claimed.

We claim:

1. A graphic assembly in combination with an object having a substantially planar mounting surface, the graphic assembly comprising:

covering structure having graphics thereon covering at least a portion of said substantially planar surface of said object, retaining structure coupled to said covering structure and constructed and arranged to retain the covering structure adjacent to said planar surface, and tensioning structure operatively associated with the retaining structure and including cams coupled to said planar surface, said retaining structure comprising an endless cable disposed about a portion of a periphery of each said cam, said cams being pivotable between a first position wherein said cable and said covering structure are in a generally relaxed position and a second position wherein said cable and said covering structure are in a generally taut position.

2. The combination as defined in claim 1, wherein said covering structure is a sheet member formed from a plastics material and having a substantially planar surface.

3. The combination as defined in claim 1 wherein said object is a a trailer of a vehicle, at least one side of said trailer defining said planar surface.

4. The combination as defined in claim 1, wherein said covering structure has an outer surface bearing said graphics.

5. The combination as defined in claim 1, wherein said covering structure is generally rectangular and one cam is provided generally at each corner of said covering structure.

6. The combination as defined in claim 5, wherein each said cam includes a body portion and a bracket, said body portion and bracket being constructed and arranged to be coupled to said object such that a portion of said object is sandwiched between said body portion and said bracket.

7. The combination as defined in claim 1 wherein said object is a truck, at least one side of said truck defining said planar surface.

* * * * *